United States Patent [19]

Hellstrom et al.

[11] Patent Number: 4,934,868

[45] Date of Patent: Jun. 19, 1990

[54] WATER CONTROL STRUCTURE AND ROLLER ASSEMBLY THEREFOR

[76] Inventors: Richard B. Hellstrom; Thomas L. Knott, both of 2040 Colonial Rd., Unit 2, Fort Pierce, Fla. 33450

[21] Appl. No.: 302,911

[22] Filed: Jan. 30, 1989

[51] Int. Cl.[5] ..... E02B 7/26

[52] U.S. Cl. ..... 405/104; 405/103

[58] Field of Search ..... 405/87, 93, 99–106; 49/425, 209

[56] References Cited

U.S. PATENT DOCUMENTS

| | | | |
|---|---|---|---|
| 234,996 | 11/1880 | Luck et al. . | |
| 240,564 | 4/1881 | Ware . | |
| 714,551 | 11/1902 | Adams | 405/105 |
| 880,103 | 2/1908 | Schildhauer . | |
| 1,562,113 | 11/1925 | Meyer | 405/104 |
| 1,750,901 | 3/1930 | Newell . | |
| 1,866,350 | 7/1932 | Holden . | |
| 2,006,253 | 6/1935 | Zimmermann . | |
| 2,126,783 | 8/1938 | Knerr . | |
| 2,139,488 | 12/1938 | Cicin . | |
| 2,360,961 | 10/1944 | Mayo . | |
| 3,086,366 | 4/1963 | Danel . | |
| 3,175,255 | 3/1965 | Saunders | 49/425 |
| 3,326,002 | 6/1967 | Halpenny | 405/105 |
| 3,397,490 | 8/1968 | Carlson . | |
| 4,439,061 | 3/1984 | Whipps . | |
| 4,582,451 | 4/1986 | Hollander, Jr. . | |
| 4,726,709 | 2/1988 | Labelle . | |

*Primary Examiner*—Dennis L. Taylor

*Attorney, Agent, or Firm*—Sixbey, Friedman, Leedom & Ferguson

[57] ABSTRACT

A water control structure for a flow channel comprises a structure-mounted roller assembly having a pair of elongate, generally U-shaped frame members including an upstream leg, a downstream leg and a connecting web therebetween, the frame members adapted to be positioned on opposite sides of the flow channel with the openings in the U-shape facing each other for slidably receiving and supporting in vertically stacked relationship the ends of from one to a plurality of plain flashboards therewithin for providing a height-adjustable gate of flashboards for regulating water levels. A plurality of longitudinally spaced-apart rollers are mounted on the downstream leg for facilitating longitudinal sliding movement of the flashboards in the U-shaped members, each of the rollers comprising a split wheel roller assembly including first and second spaced apart, major diameter roller surfaces. An elongate, longitudinally extending, preferably wedge-shaped notch means is formed in the downstream leg for receiving an elongate, unitary, correspondingly shaped and dimensioned seal means which projects from said notch means upstream into sealing engagment with the flashboards. The upstream leg of the U-shape desirably extends arcuately into the flow channel and curves gently downstream. Multiple elongate, longitudinally extending access passageways are defined in the frame member for facilitating access by various tools and lifting devices to locations along the longitudinal extent of the frame members and to corresponding locations on the flashboards.

15 Claims, 3 Drawing Sheets

WATER CONTROL STRUCTURE AND ROLLER ASSEMBLY THEREFOR

FIELD OF THE INVENTION

The present invention relates to water control structures and, more particularly, to water control structures utilizing one or more vertically stacked flashboard or stoplog gates for regulating water level on the upstream side of the gates.

DESCRIPTION OF THE PRIOR ART

Flashboard (or stoplog) gates have long been used as an economical method of regulating water levels in certain types of water control structures. Such gates have been employed to selectively open up or close off a channel to a flow of water. Flashboard gates typically comprise a log- or timber-retaining frame having a pair of vertical grooves formed opposite one another in the two opposing side walls of a flow channel, and a variable number of flashboards which slidably fit into the vertical wall grooves so that each flashboard extends across the channel between the two opposing flashboard side walls in a direction perpendicular to the flow of water. With this arrangement the first flashboard introduced into the vertical slide grooves slides down along the grooves until it comes to rest on the bottom surface of the channel, and any additional flashboards subsequently introduced into the vertical side grooves stack one upon another. In this way the flashboards, in combination with the bottom surface of the channel and the side walls of the channel, form a barrier to the flow of water. The flashboards are typically made of timber and vary in size depending upon the type of structure, depth of water and desired results. In a typical application, a flashboard may be three (3) inches thick, eight (8) inches high and seven (7) feet long. By varying the number of flashboards used in the gate, and also the height of the flashboards used in the gate, the level of the flashboard barrier within the channel can be regulated as desired. In this way the height may be varied to which the water must rise on the upstream side before the highest flashboard is finally overtopped by the water for discharge to the downstream side.

Early flashboard members were typically formed of logs or simple wooden planks. Later steel and/or concrete beams were also employed as flashboards. However, since the height of the water barrier in a flashboard gate can only be adjusted by the addition or removal of flashboards into and out of the vertical grooves formed in the side walls of the channel, it has been found desirable to have the flashboards formed out of the lightest possible materials in order to facilitate manipulation of the flashboards. At the same time, however, it has also been found desirable to make the flashboards as strong as possible so that the flashboards may adequately resist the force of the water in the channel, and also so that the flashboards may survive any possible collisions with foreign objects which may be carried along by the water. As a result, more recent efforts have been made to fabricate relatively strong flashboards out of strong, lightweight materials such as aluminum.

From time to time it becomes necessary to remove or pull a flashboard from the vertical stack. This may be occasioned, for example, by a desire to reduce the height of the stacked flashboards or by a need to replace a damaged flashboard. The number of men or the equipment required to pull a flashboard is dependent upon a number of factors which contribute to the high coefficient of friction that usually exists between the flashboard and the grooves in which it resides. For example, longer flashboard lengths and greater water pressures make flashboards more difficult to pull, since both factors increase the total horizontal force on the flashboard. As the horizontal force increases the friction sometimes increases to the point that the flashboard becomes almost impossible to pull. When this occurs, it frequently results in upstream flooding at times of heavy rainfall in the upstream drainage basin.

One attempted solution to this problem has been to mount rollers on the flashboards to reduce sliding friction and, thereby, facilitate their movement within the slots. U.S. Pat. No. 1,562,113—Meyer, U.S. Pat. No. 1,750,901—Newell, U.S. Pat. No. 2,006,253—Zimmerman, U.S. Pat. No. 2,126,783—Knerr, U.S. Pat. No. 2,139,488—Cicin, U.S. Pat. No. 2,360,961—Mayo, and U.S. Pat. No. 3,086,366—Danel are illustrative of prior art water control devices, such as sliding gates and movable weirs, which are roller mounted for reducing the friction associated with raising and lowering the gate or weir. Another attempted solution has been to mount rollers on or within the fixed portion of the water control support structure, e.g., within the grooves in which the flashboards are positioned. U.S. Pat. No. 240,564—Ware and U.S. Pat. No. 880,103—Schildhauer are illustrative of the use of support structure mounted rollers.

While roller mounting water control gates is an effective approach to overcoming the sliding friction problem, the types of roller assemblies illustrated in the aforementioned patents are not practical, for economic and other reasons, for use in small, low-cost water control structures which employ one or a plurality of plain, vertically stacked flashboards for crest control. As contrasted with more expensive and sophisticated devices, the use of flashboards and their ability to offer crest control protection assures that the groundwater table will not drop below a predetermined elevation. This is important in water management work because it prevents overdrainage. It also eliminates the need for constant monitoring of water levels, as required when other types of discharge control devices are used.

Therefore, notwithstanding that water control structures are well known in which the water level control gates slide, with roller assistance, within structure mounted sliding support means there remains a need for structures which are particularly practical to use in connection with low cost, unmonitored and unattended installations which employ plain (as contrasted with roller-mounted) flashboards. Thus, the primary needs of such structures, in addition to simplicity and low cost, include reliability and ease of operation to reduce the effort of pulling flashboards and to permit such pulling without the need for heavy equipment. In addition, such structures must be readily installable, with a minimum of modification, on existing structures.

SUMMARY OF THE INVENTION

In one aspect of the present invention there is provided a structure-mounted roller assembly for slidably receiving and supporting and for facilitating the use of plain flashboards in a water control structure in which water level regulation is efficiently accomplished by adding or removing, via vertical stacking, one or more of such plain flashboards for adjusting the height of the water control gate in the structure.

In another aspect of the invention there is provided a structure-mounted roller assembly comprising a pair of elongate, generally U-shaped frame members adapted to be positioned on opposite sides of a flow channel with the openings in the U-shapes of each frame member opposite and facing each other for receiving the ends of from one to a plurality of vertically stackable flashboards therewithin, each of the U-shaped frame members having an upstream leg, a downstream leg and a connecting web therebetween, and a plurality of longitudinally spaced-apart roller means mounted on the downstream leg for facilitating the longitudinal sliding movement of the flashboards into and out of the U-shaped frame members.

In a preferred aspect of the invention, the roller means comprises a split wheel roller assembly including first and second spaced-apart major diameter roller surfaces and lesser diameter connecting means therebetween, the roller assembly being mounted for rotation about an axis extending generally parallel to the downstream leg of the U-shape.

In still another aspect of the invention, elongate, longitudinally extending notch means are formed in the downstream leg for receiving an elongate seal means therewithin, the seal means desirably being unitary and elastomeric and comprising, in cross-section, a retaining portion shaped for snug insertion into and retention within the notch means and a sealing portion projecting upstream from the retaining portion for water-tight sealing engagement with the downstream face of the flashboards. Desirably, the notch means and the retaining portion are each wedge-shaped and correspondingly sized for permitting the seal to be retained within the notch means without the use of hardware, thus minimizing maintenance and facilitating the periodic replacement of the seal.

In yet another aspect of the invention at least one elongate, longitudinally extending access passageway is formed in the downstream leg for permitting access to locations along the longitudinal extent of the frame members and corresponding locations on the flashboards. This passageway permits and guides the insertion of gate lifting apparatus, if such becomes necessary for flashboard removal, or of cleaning means for cleaning of the roller means along the longitudinal extent of the frame members.

In another aspect of the invention the lesser diameter connecting means of the split wheel roller assembly defines with the upstream face of the downstream leg and the downstream face of the flashboards, respectively, separate elongate, longitudinally extending access passageways for permitting access to locations along the longitudinal extent of the frame member and corresponding locations on the flashboards and for accommodating gate guides that may be attached to the downstream face of the flashboards.

In still another aspect of the invention the upstream leg extends arcuately into the flow channel and curves downstream for defining a generally convex upstream and generally concave downstream face thereof. The arcuate upstream leg deflects water-borne debris, protecting the rollers, improves entrance hydraulics and guides and restricts the position of the flashboards to assure proper vertical stacking. In a preferred aspect, stiffening means are employed for supporting the upstream leg along the downstream concave surface thereof.

In a further aspect, the present invention provides a water control structure for a flow channel comprising a structure-mounted roller assembly, as described hereinbefore, having a pair of elongate, generally U-shaped frame members positioned on opposite sides of the flow channel with the openings in the U-shapes of each frame member opposite and facing each other for slidably receiving and supporting, in a vertically stacked manner, the ends of from one to a plurality of plain flashboards therewithin for providing a height-adjustable, wall of plain flashboards for regulating water level.

BRIEF DESCRIPTION OF THE DRAWINGS

The invention will be better understood from a consideration of the following description taken together with the following drawings, in which.

DESCRIPTION OF THE PREFERRED EMBODIMENTS

Figure 1:
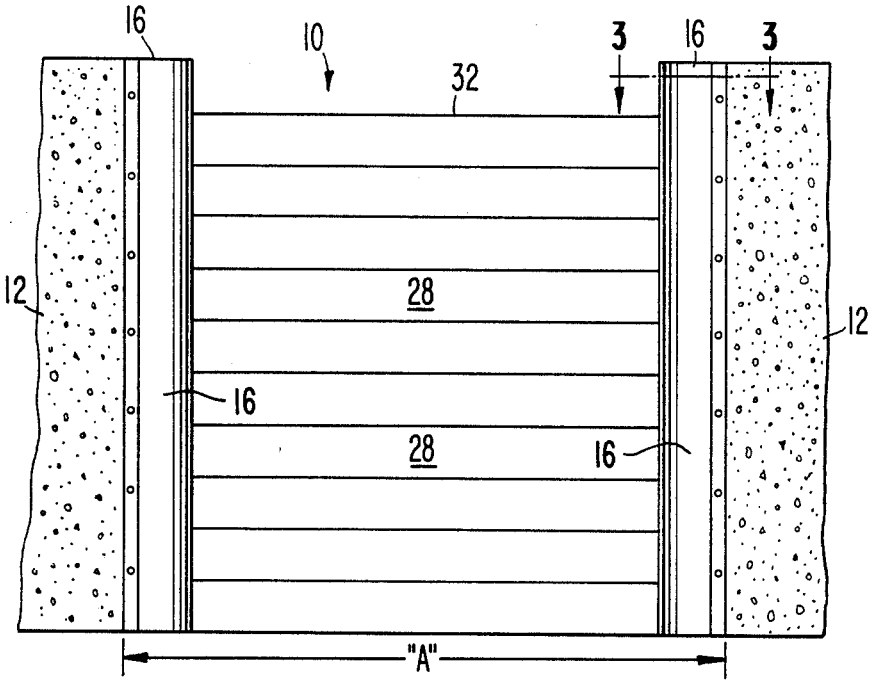
FIG. 1 is a partial elevational view of the upstream side of a typical water control structure of the present invention.
Figure 2:
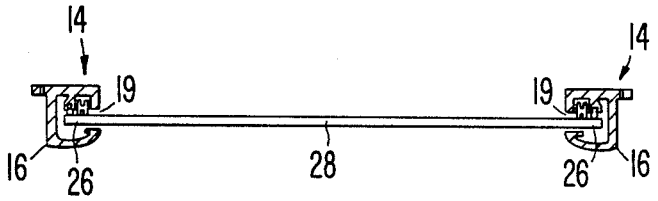
FIG. 2 is a partial plan view of the structure of FIG. 1.

Referring now to the drawings and, initially, to FIG. 1, there is shown generally at 10 the water control structure of the present invention looking downstream at the upstream side thereof. Structure 10 spans flow channel "A" and includes walls 12 on opposite sides of channel A supporting and affixed to, as by bolts, the roller assembly 14 of the present invention. As can be seen from FIGS. 2–5 as well, roller assembly 14 includes a pair of elongate, generally U-shaped, in cross-section, frame members 16, which may advantageously be extruded aluminum members but also may be fabricated or formed of a material other than aluminum. Frame members 16 are positioned on opposite sides of flow channel "A" with the openings 19 in the U-shape of each frame member opposite and facing each other. Received within the U-shape of opposite frame members 16 are the opposite ends 26 of from one to a plurality of elongated (horizontally extending in the drawing) flashboards 28 which may be vertically stacked one on top of the other along their elongated side margins so to achieve a desired height for water control purposes. It will be appreciated that the height may be adjusted by adding or removing flashboards 28. As used herein, the term "flashboards" is intended to include flashboards or stoplogs for forming single-unit or multiple-unit water control gates. As shown, for example, in FIG. 1, a plurality of flashboards are vertically stacked with their ends 26 supported in frame members 16 for defining water control gate 32.

Figure 3:
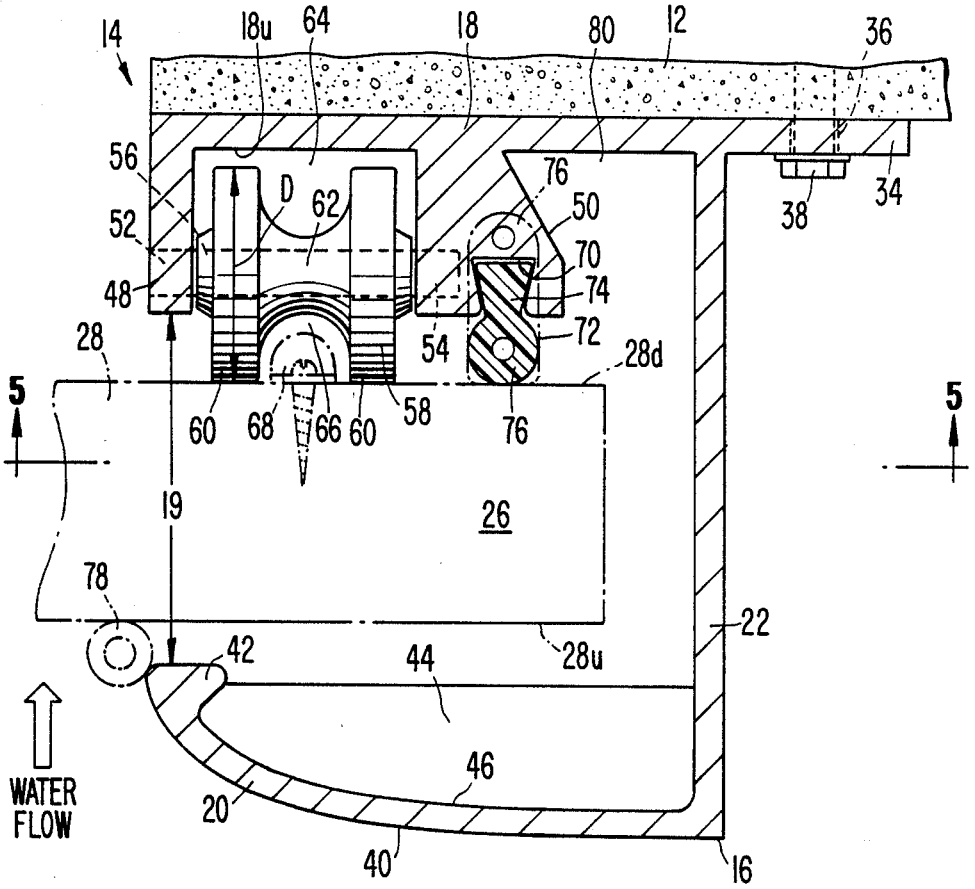
FIG. 3 is a top sectional view taken along lines 3—3 of FIG. 1.
Figure 4:
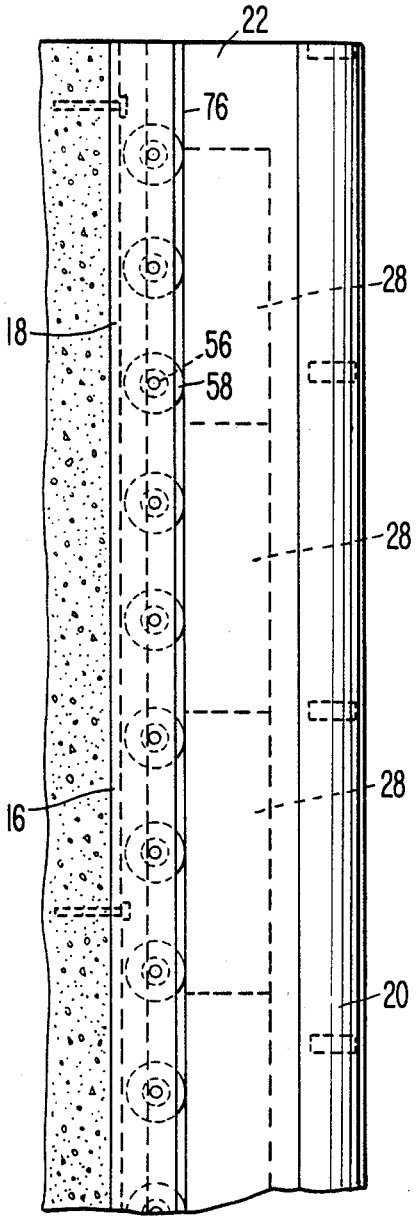
FIG. 4 is a side elevation view of a portion of the water control structures of FIG. 1 showing the preferred positional relationship between the rollers and the vertically stacked flashboards.
Figure 5:
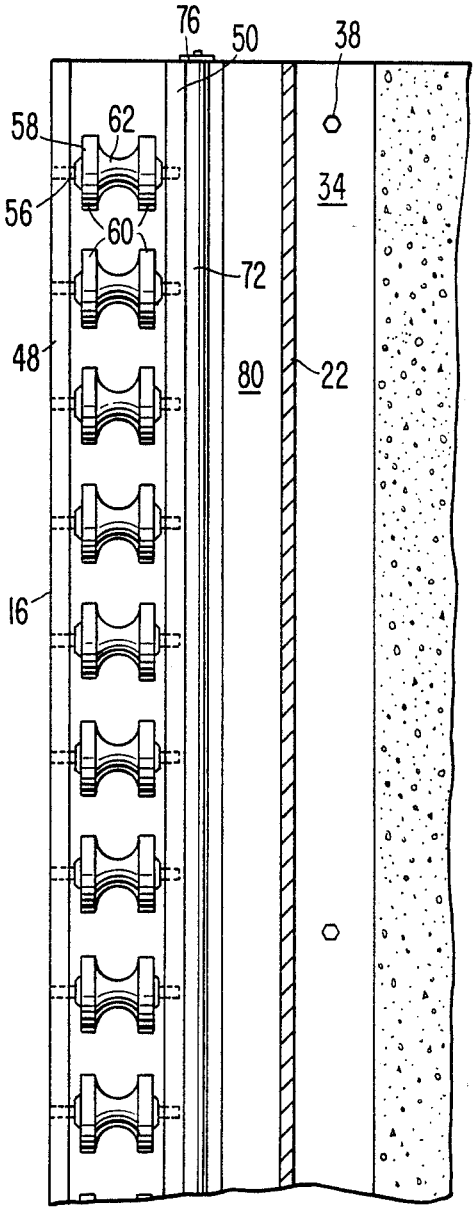
FIG. 5 is a partial elevation view showing the interior elements of the roller assembly, taken generally along line 5—5 of FIG. 3.

Referring to FIGS. 2–5, it can be seen that the generally U-shaped cross-section of frame member 16 includes a downstream leg 18, an upstream leg 20 and a connecting web 22 with the opening 18 in the U-shape defined between the downstream and upstream legs 18, 20 for receiving the end 26 of a flashboard 28 therewithin (as shown in phantom in FIG. 3). An extension 34 of frame member 16, shown preferably in the same plane as downstream leg 18, includes holes 36 therein for attaching the roller assembly 14 to the structure wall 12, as with connecting means, such as bolts 38. Alternatively, roller assembly 14 may be cast as a part of the structure walls 12.

Upstream leg 20 extends arcuately from web 22 into flow channel A and gently curves downstream for improving entrance hydraulics and decreasing entrance losses, thereby enhancing the flow characteristics of the water control structure. The resulting generally convex-shaped upstream surface 40 deflects water-borne debris traveling in the flow channel and assists in keeping such debris from interfering with the operation of the rollers of roller assembly 14 and clogging the elongate, longitudinally extending passageways (e.g., 64, 66, 80) which are formed in and with downstream leg 18. In addition, as can be best seen in FIG. 3, arcuate upstream leg 20 serves as a guide for flashboards 28 and end portion 42, thereof serves as a means for preventing flashboards 28 from moving in an upstream direction which otherwise might allow an upper flashboard, in a vertically stacked multi-flashboard arrangement as shown in FIG. 1, to drop to a lower level next to another flashboard 28, and, in so doing, not only to defeat the vertical stacking design of gate 32 but also to impair the ability to remove the remaining lower flashboards 28 should such become desirable. In a preferred form of the invention, upstream leg 20 may be structurally reinforced by positioning a stiffening web 44 along generally concave-shaped downstream surface 46 and web 22. This enhances the structural characteristics of the arcuate portion of upstream leg 20 in resisting the forces created by the potential damaging impact of water-borne debris with upstream leg 20.

Downstream leg 18 includes a pair of upstream projecting portions 48,50 having openings 52,54 formed therein for receiving and supporting the ends of roller axle 56. Mounted on roller axle 56 at a plurality of longitudinally spaced-apart locations along the longitudinal extent of each frame member 16 (see FIGS. 4 and 5) are a plurality of rollers 58 for facilitating the insertion, lowering, withdrawal and removal of flashboards 28 from within the U-shaped frame members 16. Desirably, rollers 58 are split-wheel rollers which, as can be seen from FIG. 3, are characterized by first and second spaced-apart roller surfaces 60 having major diameters "D" and smaller diameter (from zero to less than "D") connecting means 62 therebetween. The particular configuration of the split-wheel rollers or the manner of their construction is of little importance to the present invention. Thus, the split-wheel effect may be achieved by notching a solid cylindrical roller, by providing either a uniform or varying diameter connecting means or by providing two independently mounted spaced-apart roller surfaces 60 on axle 56 with no connecting means whatever therebetween.

It will be appreciated from FIG. 3 that the configuration of split-wheel roller 58 creates a downstream longitudinally extending access passageway 64 between connecting means 62 and the upstream face 18u of downstream leg 18. In similar manner, as the force of the water flow (see WATER FLOW arrow in FIG. 3) forces flashboards 28 downstream against the major diameter roller surfaces 60, the configuration of split-wheel roller 58 creates an upstream longitudinally extending access passageway 66 between connecting means 62 and the downstream face 28*d* of flashboard 28. Both passageways 64,66 permit the insertion of a cleaning tool therewithin which can be inserted and withdrawn along the entire longitudinal extent of roller assembly 14 and frame members 16. Such a tool may be as simple as a rigid hollow tube or pipe connected to an air compressor or water pump which furnish air or water to the pipe for ejecting the air or water under pressure from the open end of the pipe into the areas around rollers 58 for flushing the rollers of any accumulated debris. Both passageways 64,66 (preferably passageway 66) likewise permit the insertion and lowering, to the appropriate flashboard 28, of the guide element for a lifting device for engaging with an appropriate lifting ring, hook or other device (not shown) on the flashboard 28 for removing the flashboard 28 from the U-shaped frame members 16. In addition, passageway 66 permits the provision of a guiderail, track or other guiding means 68 (shown in phantom in FIG. 3) projecting downstream from the downstream face 28*d* of flashboards 28 into passageway 66 for maintaining the flashboards 28 in horizontal (left to right in FIG. 3) alignment during insertion, removal and use. In one embodiment of the invention, guiding means 68 may take the form of a hook or other device appropriate for engaging the aforementioned lifting device and thus may double as a flashboard guide and lifting device connector.

Upstream extending portion 50 of downstream leg 18 has a generally wedge-shaped, longitudinally extending notch 70 formed therein along the entire longitudinal extent of frame members 16 for receiving an elongate, elastomeric seal means 72 therewithin. Seal means 72 is desirably unitary and elongate and is formed, in cross-section, with a generally wedge-shaped retaining portion 74 which fits snugly within notch 70 and a sealing portion 76 which projects upstream from the retaining portion 74 and is seated in sealing engagement against the downstream face 28*d* of the flashboards 28 by the water flow pressure on the upstream face 28u of the flashboards 28. As can be seen from FIG. 3, with the flashboard 28 in sealing engagement with seal means 72, leakage from the upstream side of flashboards 28 around the ends 26 thereof is prevented.

The notch 70 and seal means 72 are noteworthy in that the seal means 72 requires no hardware for maintaining it in position along its entire length on frame member 16. The wedge-shaped design of the notch 70 and the corresponding wedge-shape of the retaining portion 74 of seal means 72 (with the downstream transverse dimension larger than the upstream transverse dimension) allows the seal means 72 to be inserted within notch 70 by removing notch cover 76 (shown in phantom in FIG. 3) from the top end of frame member 16 and inserting, by pushing the retaining portion 74 of seal means 72, with the aid of a lubricant, vertically into the notch 70. Thereafter, the wedge-shaped design of the notch 70 and retaining portion 74 of seal means 72 prevent the seal means from being removed from notch 70 in any horizontal direction. Seal means 72 cannot be displaced vertically downwardly since its lower end is seated on the bottom of the water control structure. Likewise, it cannot be displaced vertically upwardly because notch cover 76 is normally fastened over the top end of notch 70. Notwithstanding its secure positioning within the frame member 16 during use, seal means 72 can be easily replaced for maintenance purposes in much the same manner as it was originally inserted. Notch cover 76 is removed, the old, worn seal means 72 is pulled vertically upwardly from notch 70 through the top end thereof and a new seal means 72 is inserted by pushing, with the aid of a lubricant, the retaining portion 74 thereof vertically into the notch. Of particular note is that this seal replacement operation can be performed without removing any flashboards or altering the water level merely by inserting a temporary seal, such as a flexible tube or strip 78 (shown in phantom in FIG. 3), along the entire longitudinal extent of the frame member, in the space between the flashboards 28 and the exterior extremity 42 of upstream leg 20.

A lifting apparatus guide passageway 80 formed in downstream leg 18 provides an alternate elongate, longitudinally extending access passageway for obtaining access to locations along the longitudinal extent of frame member 16 and to corresponding flashboard locations. Passageway 80 permits the insertion of a cleaning tool, if desired, or the guide element of a lifting device for attachment to an appropriate lifting ring, hook or other device (not shown) on the flashboard 28 for removing the flashboard 28 from the frame members 16.

It will be appreciated that numerous modifications can be made to the water control structure hereindescribed without departing from the scope of the invention. For example, the roller assembly can be mounted, singly or in multiple-units, in any manner or orientation which will facilitate the sliding movement of the flashboards thereover. The roller assembly with appropriate gates, could be used to control the flow of fluids other than water, e.g., the flow of particulates, such as earthen materials or grains. The seal means 72 could be located on the side of roller 58 remote from web 22.

INDUSTRIAL APPLICABILITY

The water control structure of the present invention is broadly applicable to water management and level control for preventing upstream flooding at times of heavy rainfall in upstream drainage basins. This is accomplished in accordance with the present invention by providing a roller assembly which is readily installed on existing structures and is characterized by ease of operation and reliability for reducing the effort necessary for pulling flashboards and, thereby, adjusting the height of the water control gate. Particularly instrumental in reducing friction during the removal of gates are the use of structure-mounted split-wheel rollers which, in addition to facilitating flashboard removal, permit the provision of elongate, longitudinally extending passageways. These passageways allow periodic cleaning of the rollers and, if necessary, the insertion of a lifting device for attaching to and removing flashboards. The self-retained seal means of the present invention, acting cooperatively with the rollers and passageways and with the arcuate upstream leg of the frame member, also assists in facilitating flashboard removal. The upstream leg deflects debris from and, thereby, protects the split wheel roller from fouling. Likewise, the seal means protects the rollers from debris which manages to elude the downstream leg and get within the U-shape and around the ends of the flashboards. It will, therefore, be appreciated that the multiple individual features of the present water control structure act individually and cooperatively to provide a structure which operates more efficiently and more economically than structures heretofore known or suggested for the same purpose.

We claim:

1. A water control structure-mounted roller assembly for slidably receiving and supporting from one to a plurality of plain flashboards therein, said flashboards comprising a water control gate for controlling water flow in a flow channel across which said gate extends, comprising:

a pair of elongate, generally U-shaped frame members adapted to be positioned on opposite sides of a flow channel with the openings in said U-shapes of each frame member opposite and facing each other, said U-shaped frame members adapted for receiving the ends of from one to a plurality of vertically stackable flashboards therewithin, each of said U-shaped frame members having an upstream leg, a downstream leg and a connecting web therebetween;

a plurality of longitudinally spaced-apart rollers mounted on said downstream leg for facilitating longitudinal sliding movement of said flashboards in said U-shaped members, each of said rollers comprising a split wheel roller assembly including first and second spaced-apart, major diameter roller surfaces, said roller assembly being supportably mounted at opposite end portions thereof on said downstream leg for rotation about an axis extending generally parallel to said downstream leg;

said major diameter roller surfaces and the upstream face of said downstream leg defining therebetween a first elongate, longitudinally extending access passageway in said frame member for permitting access to locations along the longitudinal extent of said frame member; and said major diameter roller surfaces and the downstream face of said flashboards defining therebetween a second elongate, longitudinally extending access passageway in said frame member for permitting access to locations on said flashboards.

2. A roller assembly, as claimed in claim 1, wherein said upstream leg extends arcuately into said flow channel and curves downstream for defining generally convex upstream and generally concave downstream surfaces thereof.

3. A roller assembly, as claimed in claim 2, including stiffening means for reinforcing said upstream leg.

4. A roller assembly, as claimed in claim 3, wherein said stiffening means comprises web means supporting said upstream leg along the downstream concave surface thereof.

5. A roller assembly, as claimed in claim 1, including elongate, longitudinally extending notch means formed in the upstream face of said downstream leg for removably receiving elongate seal means therewithin, and elongate, unitary seal means for insertion within said notch means comprising, in cross-section, a retaining portion configured for snug insertion into and frictional retention within said notch means and a sealing portion projecting upstream from said retaining portion for sealing engagement with the downstream face of said flashboards.

6. A roller assembly, as claimed in claim 5, wherein said notch means is generally wedge-shaped in cross-section with the downstream transverse dimension of said notch larger than the transverse dimension of said notch at the upstream face of said downstream leg, and said seal means has a correspondingly dimensioned, wedge-shaped cross-section.

7. A roller assembly, as claimed in claim 6, including removable cover means covering the upper end of said notch means.

8. A roller assembly, as claimed in claim 1, including a third elongate, longitudinally extending access passageway formed in said downstream leg for permitting access to locations along the longitudinal extent of said frame member and to corresponding locations on said flashboards.

9. In a water control structure for a flow channel comprising a structure-mounted roller assembly having a pair of elongate, generally U-shaped frame members adapted to be positioned on opposite sides of said flow channel with the openings in the U-shape facing each other for slidably receiving and supporting in vertically stacked relationship the ends of from one to a plurality of plain flashboards therewithin for providing a height-adjustable wall of said flashboards for regulating water levels, each of said U-shaped frame members having an upstream leg, a downstream leg and a connecting web therebetween, the improvement comprising:

a plurality of longitudinally spaced-apart rollers mounted on said downstream leg for facilitating longitudinal sliding movement of said flashboards in said U-shaped members, each of said rollers comprising a split wheel roller assembly including first and second spaced-apart, major diameter roller surfaces, said roller assembly being supportably mounted at opposite end portions thereof on said downstream leg to said downstream leg, said major diameter roller surfaces and the upstream face of said downstream leg defining therebetween a first elongate, longitudinally extending access passageway in said frame member for permitting access to locations along the longitudinal extent of said frame member, and said major diameter roller surfaces and the downstream face of said flashboards defining therebetween a second elongate longitudinally extending access passageway in said frame member for permitting access to locations on said flashboards.

10. A water control structure, as claimed in claim 9, wherein said upstream leg extends arcuately into said flow channel and curves downstream for defining generally convex upstream and generally concave downstream surfaces thereof.

11. A water control structure, as claimed in claim 9, including elongate, longitudinally extending notch means formed in the upstream face of said downstream leg for removably receiving elongate seal means therewithin, and elongate, unitary seal means for insertion within said notch means comprising, in cross-section, a retaining portion configured for snug insertion into and frictional retention within said notch means and a sealing portion projecting upstream from said retaining portion for sealing engagement with the downstream face of said flashboards.

12. A water control structure, as claimed in claim 11, wherein said notch means is generally wedge-shaped in cross-section with the downstream transverse dimension of said notch larger than the transverse dimension of said notch at the upstream face of said downstream leg, and said seal means has a correspondingly dimensioned wedge-shaped cross-section.

13. A water control structure, as claimed in claim 9, including a third elongate, longitudinally extending access passageway formed in said downstream leg for permitting access to locations along the longitudinal extent of said frame member and to corresponding locations on said flashboards.

14. A water control structure, as claimed in claim 9, including guide means projecting downstream from the downstream face of said flashboards into said space between said roller surfaces for maintaining said flashboards in transverse alignment.

15. A water control structure, as claimed in claim 1, including guide means projecting downstream from the downstream face of said flashboards into said space between said roller surfaces for maintaining said flashboards in transverse alignment.

* * * * *